US005528106A

United States Patent [19]

Jansen et al.

[11] Patent Number: 5,528,106

[45] Date of Patent: Jun. 18, 1996

[54] ELECTRIC LAMP WITH H-SHAPED PINCHED SEAL

[75] Inventors: Johannes M. Jansen, Eindhoven, Netherlands; Koen L. C. Lenaerts, Turnhout, Belgium

[73] Assignee: U.S. Philips Corporation, New York, N.Y.

[21] Appl. No.: 290,409

[22] Filed: Aug. 15, 1994

[30] Foreign Application Priority Data

Aug. 18, 1993 [EP] European Pat. Off. ..... 93202439

[51] Int. Cl.[6] ..... H01J 17/18

[52] U.S. Cl. ..... 313/623; 313/624

[58] Field of Search ..... 313/623, 624, 313/625, 626, 318.07

[56] References Cited

U.S. PATENT DOCUMENTS

| | | | |
|---|---|---|---|
| 3,441,778 | 4/1969 | Deiss | 313/318.07 |
| 3,515,420 | 6/1970 | Thomasson et al. | 313/318.07 |
| 3,515,931 | 6/1970 | Takakuwa | 313/318.07 |
| 4,769,574 | 9/1988 | Nagasawa et al. | 313/318.09 |
| 4,979,082 | 12/1990 | Devir | 313/318.07 |
| 5,039,909 | 8/1991 | Kiesling et al. | 313/623 |
| 5,144,192 | 9/1992 | Barthelmes | 313/623 |

FOREIGN PATENT DOCUMENTS

| | | | |
|---|---|---|---|
| 2544134 | 7/1987 | Germany | H01J 5/54 |
| 368865 | 6/1963 | Switzerland | 313/318.07 |
| 1102646 | 2/1968 | United Kingdom | H01K 1/40 |
| 2103872 | 2/1983 | United Kingdom | H01J 61/36 |

*Primary Examiner*—Sandra O'Shea
*Assistant Examiner*—Vip Patel
*Attorney, Agent, or Firm*—Brian J. Wieghaus

[57] ABSTRACT

The electric lamp has a lamp vessel (1) provided with a pinch seal (4) which is H-shaped in cross sections. Metal foils (6), to which inner (8) and outer conductors (7) are connected to constitute current supply conductors (5), are embedded in the pinch seal (4). The metal foils (6) are each located in a respective plane parallel to the axis (3) of the lamp vessel (1) in a respective leg (4') of the H. This allows for a relatively large distance between the current supply conductors, although the pinch seal may have relatively small outer dimensions.

8 Claims, 2 Drawing Sheets

ELECTRIC LAMP WITH H-SHAPED PINCHED SEAL

BACKGROUND OF THE INVENTION

The invention relates to an electric lamp provided with a lamp vessel which is made of glass with an $SiO_2$ content of at least 95% by weight, in which an electric element is arranged, and which has an axis and a seal, and current conductors enclosed in the seal, each comprising a metal foil connected to a conductor issuing from the seal to the exterior and to a conductor extending to the electric element, which metal foils are each arranged in their own plane parallel to the axis of the lamp vessel.

Such an electric lamp is known from GB 2 103 872 A. The known lamp has a rotationally symmetrical fused seal. The seal was obtained in that a glass tube closed at one end or a glass rod was inserted into a tube present at the lamp vessel under construction, together with the current conductors which are arranged diametrically opposite one another. The glass tube at the lamp vessel is then heated above its softening temperature to cause it to collapse onto the metal foils.

An important disadvantage of the known lamp is that the glass tube at the lamp vessel is heated to above its softening temperature, but the glass tube or rod present therein is not. The tube at the lamp vessel in fact screens the glass tube or rod from the heat source. As a result, this latter tube or rod does not reach its softening temperature and no fusion takes place between the two glass bodies, so there will be no or a poor adhesion of the tube or rod to the metal foils. Accordingly, there is a considerable risk that the lamp will be leaky.

Another disadvantage is the complicated construction which requires much glass. The lamp has the advantage, however, that the current conductors issue from the seal to the exterior and into the lamp vessel comparatively far removed from one another. The risk of flash-over between the current conductors at comparatively high voltages is counteracted thereby.

The risk of flash-over exists, for example, in the electric lamp of GB 1 102 646 in which the metal foils are in a stacked arrangement in a pinch seal with glass interposed. The foils may be comparatively wide, and thus carry a comparatively strong current, but they lie close together, as do the conductors connected thereto.

Other electric lamps such as, for example, those known from DE 25 44 134 C2, have diametrically opposed seals through which respective current conductors extend. Flash-over outside the lamp is practically impossible as a result, but the lamp has the disadvantage that it must be connected to a supply source in two locations remote from one another and will often require two lamp caps. When the lamp is used in a reflector, for example, inconvenient shadows may be formed when a conductor returns between the lamp and the reflector from a first sea/to a second seal in order to be connected to a lamp cap together with another conductor issuing from said second seal.

SUMMARY OF THE INVENTION

It is an object of the invention to provide an electric lamp of the kind described in the opening paragraph which is of a simple construction and renders possible the use of comparatively high voltages.

According to the invention, this object is achieved in that the seal is a pinch seal which in cross-sections transverse to the axis has an H-shape, while the current conductors are enclosed in respective legs of the H.

The construction of the lamp according to the invention renders it possible to position the current conductors, both the metal foils and the conductors connected thereto, at a comparatively great distance from one another, while nevertheless the manufacture of the lamp is found to be easy and reliable. The lamp can be manufactured without the use of additional components.

It is also attractive that the pinch seal can be so dimensioned that its imaginary enveloping cylinder is equally wide as, or even less wide than the lamp vessel. This has the advantage that the pinch seal can be accommodated in a comparatively narrow reflector neck portion, so that only a small reflecting surface area need be sacrificed for this neck portion.

The lamp can be readily manufactured in that an end portion of the lamp vessel to be is heated to its softening point in the presence of the current conductors. The glass is circumferentially accessible to the heat source such as, for example, a burner during this, as is usual during the manufacture of pinch seals. Mutually opposed first pinching blocks then make a first portion of the pinch seal, i.e. the transverse portion between the legs of the H, while the current conductors are situated laterally of the pinching blocks. Subsequently, possibly after an intermediate heating stage, mutually opposed second pinching blocks make the legs of the H with the first pinching blocks acting as supporting anvils.

In general, the legs of the H and the transverse portion in between will have plane surfaces. It is alternatively possible, however, for recesses to be present in the pinching blocks, which will result in elevations on plane surfaces.

The electric element of the lamp may be an incandescent body, for example in an inert gas comprising halogen, or a pair of electrodes in an ionizable medium, for example rare gas or rare gas with mercury and/or metal halide. The electrodes in this case may each be formed by a free end of a conductor connected to a metal foil, with or without an enveloping coil or thickened portion, or by a separate body. The electric element may be accommodated in an inner envelope.

BRIEF DESCRIPTION OF THE DRAWINGS

Embodiments of the electric lamp according to the invention are shown in the drawing, in which.

DESCRIPTION OF THE PREFERRED EMBODIMENTS

Figure 1:
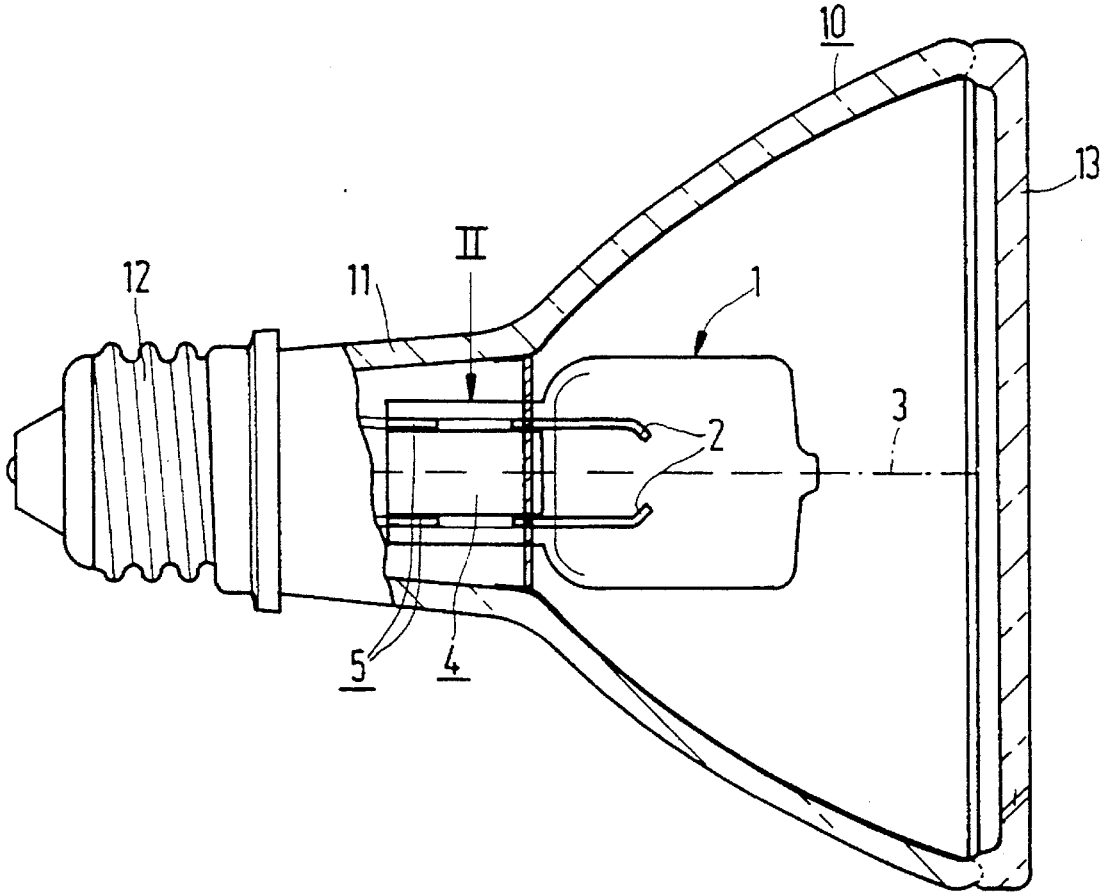
FIG. 1 shows a lamp/reflector unit partly in axial section, partly in side elevation.
Figure 2:
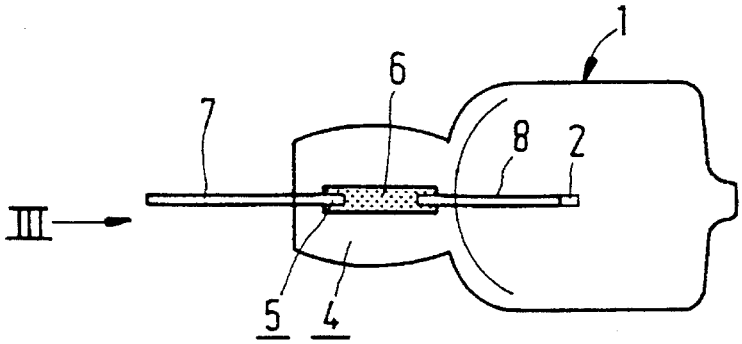
FIG. 2 is a side elevation of the lamp vessel of FIG. 1.

In the drawing, the electric lamp has a lamp vessel 1 of glass with an $SiO_2$ content of at least 95% by weight, such as quartz glass, in which an electric element 2 is arranged and which has an axis 3 and a seal 4. The electric element in the drawing is a pair of electrodes, formed by the free ends of the conductors 8. Current conductors 5 are enclosed in the seal 4. They each comprise a metal foil 6, for example made of molybdenum, connected to a conductor 7, for example made of molybdenum, issuing from the seal to the exterior, and to a conductor 8, for example made of tungsten, extending to the electric element 2. The metal foils 6 each lie in their own plane parallel to the axis 3 of the lamp vessel 1.

Figure 3:
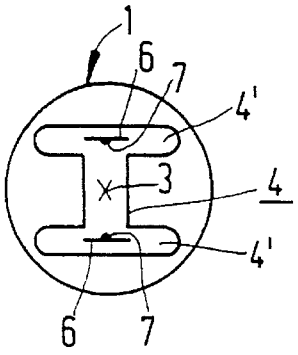
FIG. 3 is an axial view of the lamp vessel of FIG. 1.

The seal 4 is a pinch seal which has an H-shape in cross-sections transverse to the axis 3 (see FIG. 3). The current conductors 5 are enclosed in respective legs 4' of the H.

The pinch seal has an imaginary enveloping cylinder which is less wide than the lamp vessel 1. FIG. 3 shows that the lamp vessel 1 has greater external dimensions than the pinch seal.

The pinch seal 4 (FIG. 1 ) is accommodated in the neck portion 11 of a reflector body 10 which has a lamp cap 12 and is closed off with a transparent plate 13.

Figure 4:
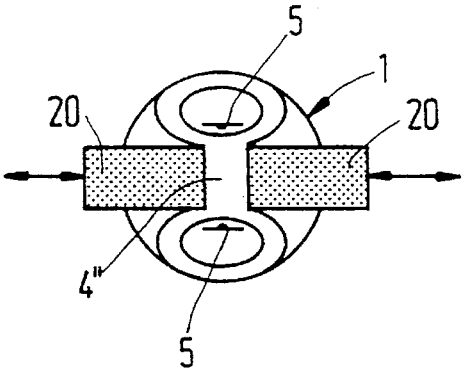
FIGS. 4 and 5 are diagrammatic pictures each showing a step in the manufacture of the pinch seal.

FIG. 4 shows a first step in the manufacture of the pinch seal 4. Cooperating pinching blocks 20 have been moved towards one another after the glass had been heated to its softening point and have formed the transverse portion 4" between the legs 4' of the H-shaped pinch seal yet to be formed, while the current conductors are situated laterally of the pinching blocks.

Figure 5:
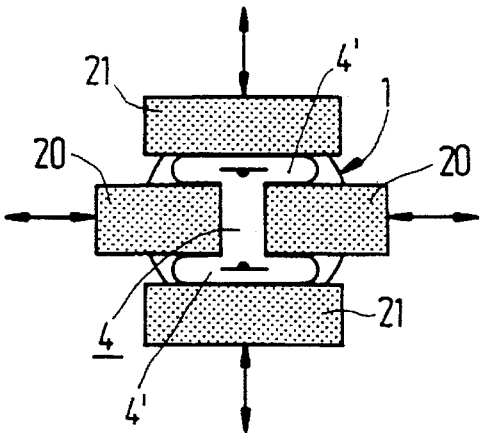

In FIG. 5, cooperating pinching block 21 have moved together, forming the legs 4' of the pinch seal with the pinching blocks 20 acting as anvils. The pinch seal was found to be reproducible and vacuum tight.

We claim:

1. An electric lamp comprising a lamp vessel comprising glass with an $SiO_2$ content of at least 95% by weight, said lamp vessel having a lamp axis and a seal sealing said lamp vessel in a gas-tight manner, an electric element arrange within the lamp vessel, and current conductors enclosed in the seal, each comprising a first conductor portion issuing from the seal to the exterior, a second conductor portion extending to the electric element, and a metal foil bridging said first and second conductor portions;

said metal foils each being arranged in their own plane parallel to the axis of the lamp vessel and said seal being a pinch seal which in cross-sections transverse to the axis has an H-shape with respective legs, said current conductors being enclosed in respective legs of the H.

2. An electric lamp as claimed in claim 1, characterized in that the pinch seal, when viewed in the direction of the lamp axis, is fully within the outer circumference of the lamp vessel.

3. An electric lamp as claimed in claim 2, further comprising a reflector body with a neck portion, and said pinch seal being accommodated in the neck portion of the reflector body.

4. An electric lamp as claimed in claim 1, further comprising a reflector body surrounding said lamp vessel and having a neck portion in which said pinch seal is accommodated.

5. An electric lamp, comprising:

(a) a lamp vessel enclosing a volume and consisting of glass having a $SiO_2$ content of at least 95% by weight, said lamp vessel defining a lamp axis and having a pinched seal sealing said lamp vessel in a gas-tight manner, said seal having (i) two legs extending longitudinally parallel to the lamp axis and spaced from each other on opposite sides of said lamp axis, said legs facing each other and having a cross-sectional dimension, in a plane perpendicular to the lamp axis, in one direction which is substantially longer than in a second dimension direction transverse to the first direction, and (ii) a connecting portion connecting said legs and extending substantially the entire length of said legs along the direction of the lamp axis; and (b) a pair of current conductors, each extending through a respective one of said legs of said seal in a gas-tight manner, each current conductor including a first conductor portion extending into said volume enclosed by said lamp vessel, a second conductor portion extending to the exterior of said seal, and a foil connecting said first and second conductor portions, said foil having a largest cross-sectional dimension extending along said one direction of the respective leg.

6. A lamp according to claim 5, wherein said connecting portion extends between the midpoints of said legs.

7. An electric lamp, comprising:

(a) a glass lamp vessel, said lamp vessel enclosing a volume, defining a lamp axis and having a seal sealing said lamp vessel in a gas-tight manner, said seal having (i) two legs extending longitudinally parallel to the lamp axis and spaced from each other on opposite sides of said lamp axis, said legs facing each other and having a cross-sectional dimension, in a plane perpendicular to said lamp axis, in one direction which is substantially longer than in a second dimension direction transverse to the first direction, and (ii) a connecting portion connecting said legs and extending substantially the entire length of said legs along the direction of the lamp axis; and (b) a pair of current conductors, each extending through a respective one of said legs of said seal in a gas-tight manner, each current conductor including a first conductor portion extending into said volume enclosed by said lamp vessel, a second conductor portion extending to the exterior of said seal, and a foil connecting said first and second conductor portions, said foil having a largest cross-sectional dimension extending along said one direction of the respective leg.

8. A lamp according to claim 7, wherein said connecting portion extends between the midpoints of said legs.

* * * * *